US008349093B2

(12) United States Patent
Cooper et al.

(10) Patent No.: US 8,349,093 B2
(45) Date of Patent: Jan. 8, 2013

(54) METHOD OF PLASMA NITRIDING OF ALLOYS VIA NITROGEN CHARGING

(75) Inventors: Clark VanTine Cooper, Glastonbury, CT (US); Krassimir G. Marchev, Sudbury, MA (US); Bill C. Giessen, Cambridge, MA (US)

(73) Assignee: Sikorsky Aircraft Corporation, Stratford, CT (US)

( * ) Notice: Subject to any disclaimer, the term of this patent is extended or adjusted under 35 U.S.C. 154(b) by 837 days.

(21) Appl. No.: 12/479,904

(22) Filed: Jun. 8, 2009

(65) Prior Publication Data

US 2009/0246551 A1 Oct. 1, 2009

Related U.S. Application Data

(62) Division of application No. 10/870,489, filed on Jun. 17, 2004, now Pat. No. 7,556,699.

(51) Int. Cl.
*C23C 8/24* (2006.01)

(52) U.S. Cl. ..... 148/317; 148/212; 428/610

(58) Field of Classification Search ..... 148/317, 148/212; 428/610
See application file for complete search history.

(56) References Cited

U.S. PATENT DOCUMENTS

| | | | | |
|---|---|---|---|---|
| 2,565,360 | A | 8/1951 | Dufilho | |
| 3,254,542 | A | 6/1966 | Harman | |
| 3,870,572 | A | 3/1975 | Brugger et al. | |
| 4,119,443 | A | 10/1978 | Abe et al. | |
| 4,212,687 | A | 7/1980 | Tanaka et al. | |
| 4,417,927 | A | 11/1983 | Fullman | |
| 4,702,779 | A | 10/1987 | Madsac et al. | |
| 4,844,775 | A | 7/1989 | Keeble | |
| 5,032,243 | A | 7/1991 | Bache et al. | |
| 5,102,476 | A | 4/1992 | Wahl | |
| 5,268,044 | A | 12/1993 | Hemphill | |
| 5,306,531 | A | 4/1994 | Laurence et al. | |
| 5,599,404 | A | 2/1997 | Alger | |
| 5,648,174 | A | 7/1997 | Yamagata et al. | |
| 5,782,953 | A * | 7/1998 | Shah | 75/246 |
| 5,851,313 | A | 12/1998 | Milam | |
| 6,179,933 | B1 | 1/2001 | Dodd et al. | |
| 6,660,340 | B1 | 12/2003 | Kirkpatrick | |
| 6,767,414 | B2 | 7/2004 | Uehara | |
| 2003/0226625 | A1 | 12/2003 | Kuehmann et al. | |
| 2006/0048857 | A1 | 3/2006 | Cooper et al. | |
| 2006/0048858 | A1 | 3/2006 | Cooper | |

OTHER PUBLICATIONS

N. Nakamura and S. Takaki, "Structural Control of Stainless Steel by Nitrogen Absorption in Solid State", Iron Steel Inst. Jpn. Int., 1996, vol. 36, pp. 922-926.*

ASM International, Materials Park, Heat Treating: "Introduction to Surface Hardening of Steels", Aug. 1991, vol. 4, pp. 420-424.* nitride. (2009). dictionary.oed.com. Oxford University Press. Retrieved Mar. 3, 2010, from http://dictionary.oed.com/cgi/entry/00325282?query_type=word&queryword=nitride.*

(Continued)

*Primary Examiner* — Jessee R. Roe
(74) *Attorney, Agent, or Firm* — Carlson, Gaskey & Olds PC

(57) ABSTRACT

A nitrided metal includes a metal core with a first microstructure and a nitrogen-containing solid solution region on the metal core. The nitrogen-containing solid solution region is free of nitride compounds and includes a second microstructure which is equivalent to the first microstructure. The first microstructure and the second microstructure are a tetragonal crystal structure.

9 Claims, 2 Drawing Sheets

OTHER PUBLICATIONS

Moller, W. Parascandola, S., Telbizova, T., Gunze;, R., Richter, E., "Surface processes and diffusion mechanisms of ion nitriding of stainless steel and aluminum", Surface & Coatings Technology, 136, 2001, pp. 73-79.

Gergory B. Olson, Morris Azrin, Edward S. Wright, "Innovations in Ultrahigh-strength Steel Techonolgy," Proceedings of the 34th Sagamore Conference held Aug. 30-Sep. 3, 1987, Lake George, NY pp. 89-111.

Davis et al., The ASM Handbook, "Plasma (Ion) Nitriding", Aug. 1991, vol. 4, pp. 420-421.

Gomes et al. ("Alternative High- and Low-Pressure Nitriding of Austenitic Stainless Steel: Mechanisms and Results", Journal of Applied Physics, vol. 9, Nov. 1, 2003, pp. 1-5.

Helena Ronkainen (Tribological Properties of Hydrogenated and Hydrogen-Free Diamond-Like Carbon Coatings, VTT Publication 434, 2001).

Elementary Principles of Chemical Processes, 3rd Ed., 2000, Felder-Rousseau, New York, NY: John Wiley & Sons, pp. 196-197.

ASM International, Materials Park, Ohio, Heat Treating, vol. 4, "Introduction to Surface Hardening of Steels", pp. 259-260, Aug. 1991.

Ashrafizadah, F. (Available online May 30, 2003), Department of Materials Engineering, Isfahan University of Technology, Iran, "Influence of plasma and gas nitriding on fatigue resistance of plain carbon (Ck45) steel".

Patnaik, Pradyot (2003). Handbook of Inorganic Chemicals. (pp. 19-23). McGraw-Hill, online version available at: http://www.knovel.com/knovel2/Toc.jsp?BookID=688&VerticalID=0.

* cited by examiner

METHOD OF PLASMA NITRIDING OF ALLOYS VIA NITROGEN CHARGING

RELATED APPLICATIONS

This application is a divisional of U.S. patent application Ser. No. 10/870,489, now U.S. Pat. No. 7,556,699, which was filed Jun. 17, 2004.

BACKGROUND OF THE INVENTION

This invention relates to case hardening of metal or alloys and, more particularly, to case hardening with a nitrogen and metal or alloy solid solution.

For components formed of metals or alloys it is often desirable to form a hardened surface case on a core of the metal or alloy to enhance the performance of the component. The hardened surface case provides wear and corrosion resistance while the core provides toughness and impact resistance.

There are various conventional methods for forming a hardened surface case. One such typical method, nitriding, utilizes gas, salt bath, or plasma processing. The nitriding process introduces nitrogen to the metal or alloy surface at an elevated temperature. The nitrogen reacts with the metal or alloy to form hard nitride compounds on the metal or alloy surface. This conventional process provides the benefit of a hardened surface case, however, the nitride compounds may be brittle, friable, cause premature failure, or be otherwise undesirable.

The nitride compounds may include a variety of different compositions, such as the $\epsilon$ and $\gamma'$ compositions of iron and nitrogen, as well as various different compositions and crystal structures. The formation of nitride compound compositions introduces some volume fraction within the transformed surface region that possesses properties that are dissimilar to those of the substrate. While the microstructural and compositional transitions are gradual, the presence of nitride compounds having dissimilar properties can lead to deleterious performance in applications that involve contact stress, such as gears and bearings.

Accordingly, it is desirable to provide a method of case hardening that avoids an abrupt change in composition and crystal structure by forming a solid solution region having a gradual transition in nitrogen concentration between the case surface and the core.

SUMMARY OF THE INVENTION

An exemplary nitrided metal includes a metal core with a first microstructure and a nitrogen-containing solid solution region on the metal core. The nitrogen-containing solid solution region is free of nitride compounds and includes a second microstructure which is equivalent to the first microstructure. The first microstructure and the second microstructure are each a tetragonal crystal structure.

An exemplary intermediate-nitrided metal includes a metal core having a nitrogen-containing solid solution surface region that is free of nitride compounds. The metal core and the nitrogen-containing solid solution surface region have a tetragonal crystal structure. A nitrogen-charged layer that includes nitride compounds is located on the nitrogen-containing solid solution surface region. The nitrogen-containing solid solution surface region includes nitrogen that has diffused from the nitrogen-charged layer.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
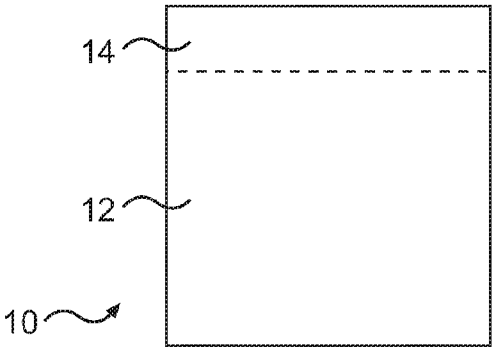
FIG. 1 shows a schematic view of a metal or alloy.

FIG. 1 shows a schematic view of a metal or alloy 10, including a core 12 and a surface region 14 of the core 12. The metal 10 is iron-based and is generally nitrogen-free, although it is to be understood that other metals or alloys will also benefit from the invention.

Figure 2:
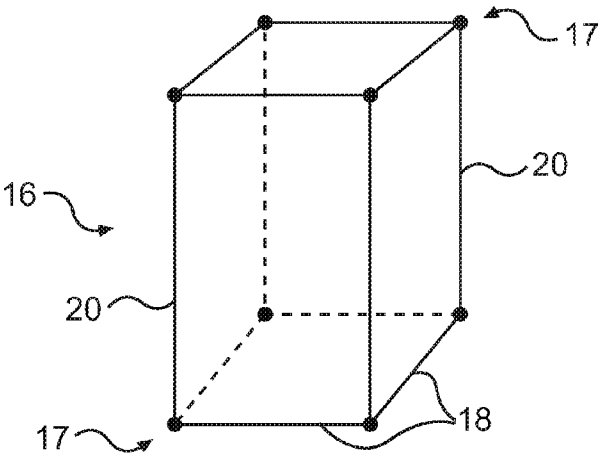
FIG. 2 shows a tetragonal crystal structure.

The core 12 and surface region 14 of the metal 10 have a generally equivalent tetragonal crystal structure 16 (FIG. 2). As illustrated in FIG. 2, the tetragonal crystal structure 16 includes atomic lattice sites 17 forming sides having length 18 which are essentially perpendicular to sides having length 20. In the tetragonal crystal structure 16, the length 18 does not equal the length 20. The tetragonal crystal structure 16 may be face-centered or body-centered. It is to be understood that the iron-based alloy may be formed instead with other crystal structures such as, but not limited to, face centered cubic and body centered cubic.

Figure 3:
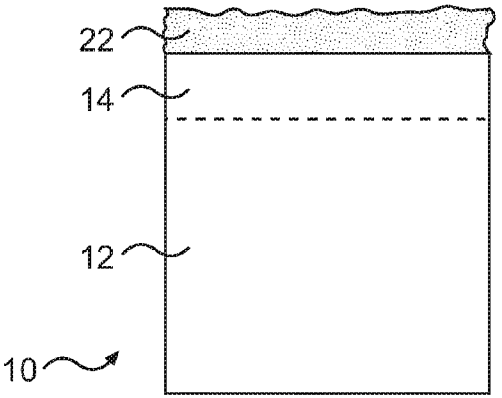
FIG. 3 shows a schematic cross-sectional view of a metal or alloy including a nitrogen-charged surface portion.

FIG. 3 shows a schematic cross-sectional view of the metal 10 and surface region 14, including a nitrogen-charged surface portion 22. A first heating process forms the nitrogen-charged surface portion 22 on the surface region 14. The first heating process includes heating the surface region 14 for a first time at a first temperature and in the presence of a nitrogen gas partial pressure.

Preferably, the first temperature is between 400° F. and 1100° F. Even more preferably, the first temperature is below a heat-treating temperature of the metal 10. The tetragonal crystal structure 16, or other crystal structure, changes when the metal 10 is heated above the heat treating temperature, thereby undesirably changing the dimensions of the metal 10. The heating process may utilize a first temperature far below the heat treating temperature of the metal 10, however, a first temperature that is generally near the heat treating temperature without exceeding the heat treating temperature provides more rapid formation of the nitrogen-charged surface portion 22.

For non-heat-treatable metals or alloys, including those having face centered cubic and body centered cubic crystal structures, selecting a first temperature at the upper end of the 400° F. to 1100° F. range reduces the first time required to form the nitrogen-charged surface portion 22. Furthermore, a high range temperature may avoid formation of deleterious microstructural phases or significantly changing the properties of the core 12 or surface region 14. For example only, the first temperature may be as high as 1100° F. for a 300-series stainless steel, which has a face centered cubic structure.

During the first heating process, the nitrogen gas partial pressure is preferably maintained at about 75% by volume, or above, of a gas atmosphere pressure of about 2.7 torr at a gas flow rate of between 280-300 $std \cdot cm^3 \cdot min^{-1}$. The gas atmosphere includes a generally inert and/or reducing gas or mixture of inert and/or reducing gases with the nitrogen gas.

The heating process is maintained for the first time. The first time is preferably between one and one hundred hours. The first time is a function of the first temperature. If the first temperature is near the heat-treating temperature of the metal 10, the heating process requires less time to form the nitrogen-charged surface portion 22 than if the temperature is far below the heat treating temperature.

Figure 4:
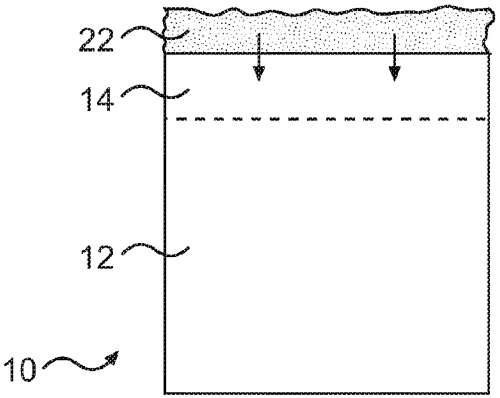
FIG. 4 shows a schematic cross-sectional view of a nitrogen-charged surface portion during interstitial diffusion.

As illustrated in FIG. 4, a second heating process heats the surface region 14 and nitrogen-charged surface portion 22 at a second temperature for a second time to interstitially diffuse nitrogen from the nitrogen-charged surface portion 22 into the surface region 14. The second heating process utilizes a reduced nitrogen partial pressure wherein the gas atmosphere pressure is reduced from about 2.7 torr to about 0.3 torr and the gas flow rate reduced from about 280-300 $std \cdot cm^3 \cdot min^{-1}$ to about 5 $std \cdot cm^3 \cdot min^{-1}$. This generally prevents growth in the thickness of the nitrogen-charged surface portion 22 and also may reduce the risk of unexpectedly heating the metal 10 by particle bombardment. It is to be understood that the required pressures and gas flows may vary according to the metal or alloy composition, crystal structure, or other characteristics.

The second time of the second heating process is preferably between one and one-hundred hours and will vary according to the desired depth of interstitial diffusion into the surface region 14. Longer times result deeper diffusion depths. Preferably, the selected time results in a nitrogen diffusion depth of about 250 micrometers, although shorter times may be used if lesser depths are desired.

Figure 5:
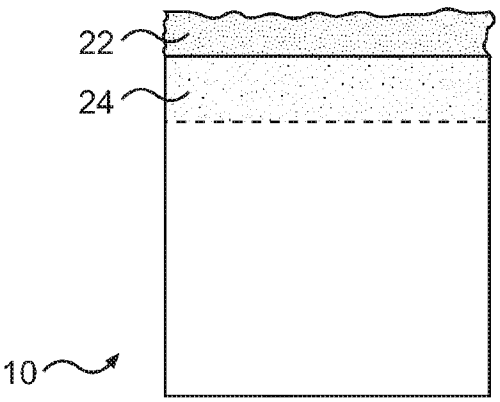
FIG. 5 shows a nitrogen-containing solid solution surface region.

As illustrated in FIG. 5, the nitrogen that interstitially diffuses into the surface region 14 transforms the surface region 14 into a nitrogen-containing solid solution surface region 24. Preferably, the second temperature during the second heating process is approximately equal to or lower than the first temperature of the first heating process to preserve the tetragonal crystal structure 16 of the surface region 14, nitrogen-containing solid solution surface region 24, and core 12.

Figure 6:
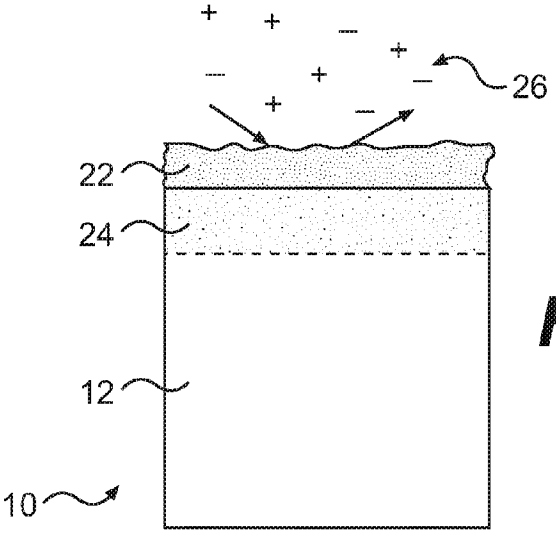
FIG. 6 shows a schematic cross-sectional view of the metal or alloy during nitrogen-charged surface portion removal.
Figure 7:
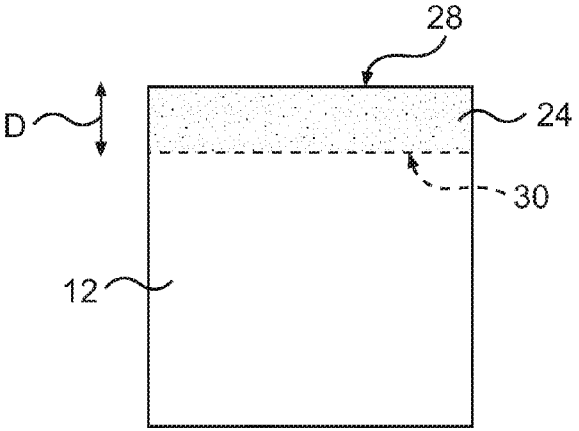
FIG. 7 shows a nitrogen-containing solid solution surface region having a gradual transition in nitrogen concentration between an inner and outer portion.

FIG. 6 shows a schematic cross-sectional view of the metal 10 during a removal step wherein the nitrogen-charged surface portion 22 is removed. The nitrogen-charged surface portion 22 is relatively brittle and maybe friable, delaminate from the nitrogen-containing solid solution surface region 24, or lead to failure through the core 12. Therefore, it is preferable to remove the nitrogen-charged surface portion 22. An ionized inert or reducing gas, such as argon or hydrogen, may be used, as appropriate, to sputter the nitrogen-charged surface portion 22, thereby removing the nitrogen-charged surface portion 22 from the nitrogen-containing solid solution surface region 24 (FIG. 7). Preferably, the gas atmosphere used during the second heating process includes the ionized gas in addition to nitrogen, and the removal step proceeds coincidentally with the second heating process. Conducting the removal step and second heating process coincidentally is particularly preferable when the removal step is the rate controlling step.

Figure 8:
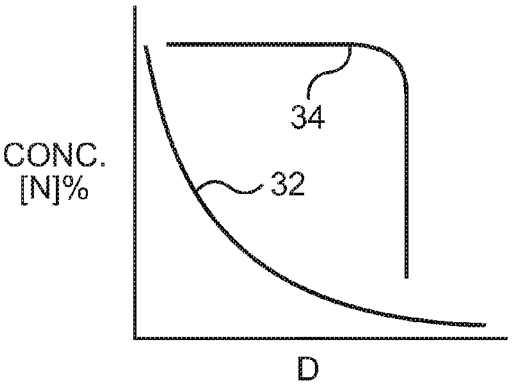
FIG. 8 shows a nitrogen concentration profile over a depth of a nitrogen-containing solid solution surface region.

As illustrated in FIGS. 7-8, the nitrogen-containing solid solution surface region 24 has a gradual transition in nitrogen concentration over a depth D between a surface 28 of the nitrogen-containing solid solution surface region 24 and an inner portion 30 of the nitrogen-containing solid solution surface region 24. The line 32 in FIG. 8 illustrates a gradual nitrogen concentration profile over the depth D. By comparison, the line 34 represents the nitrogen concentration profile before the nitrogen-charged surface portion 22 is removed (FIG. 3). At a shallow depth into the nitrogen-containing solid solution surface region 24 such as near the outer portion 28, the nitrogen concentration is relatively high compared to the nitrogen concentration in the core 12. At a deeper depth, such as near the inner portion 30, the nitrogen concentration is relatively low and approaches the nitrogen concentration of the core 12. It is to be understood that a variety of nitrogen concentration profiles may result from varying the first and second temperatures and times of the heating processes or varying the composition of the metal 10.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A treated metal comprising:

a metal core with a first microstructure; and a nitrogen-containing solid solution region on said metal core, said nitrogen-containing solid solution region is free of nitride compounds and includes a second microstructure which is equivalent to said first microstructure, and the first microstructure and second microstructure are a tetragonal crystal structure.

2. The treated metal as recited in claim 1, wherein said nitrogen-containing solid solution region is about 250 micrometers thick.

3. The treated metal as recited in claim 1, wherein said nitrogen-containing solid solution region comprises a gradual transition in nitrogen concentration between an outer surface of said nitrogen-containing solid solution region and said metal core.

4. The treated metal as recited in claim 1, wherein said metal core is an iron-based alloy.

5. An in-process metal comprising:

a metal core having a nitrogen-containing solid solution surface region that is free of nitride compounds, said metal core and said nitrogen-containing solid solution surface region each have a tetragonal crystal structure; and a nitrogen-charged layer comprising nitride compounds on said nitrogen-containing solid solution surface region, said nitrogen-containing solid solution region including nitrogen that has diffused from said nitrogen-charged layer.

6. The in-process metal as recited in claim 5, wherein said nitrogen-charged layer is harder than said metal core.

7. The in-process metal as recited in claim 5, wherein said metal core is an iron-based alloy.

8. The in-process metal as recited in claim 5, wherein said nitrogen-containing solid solution surface region is about 250 micrometers thick.

9. The in-process metal as recited in claim 5, wherein said nitrogen-containing solid solution region comprises a gradual transition in nitrogen concentration between an outer surface of said nitrogen-containing solid solution surface region and said metal core.

* * * * *